US011344938B2

(12) United States Patent
White et al.

(10) Patent No.: US 11,344,938 B2
(45) Date of Patent: May 31, 2022

(54) PAINTLESS DENT REMOVAL TOOL, SYSTEM AND METHOD

(71) Applicant: EHC INC., Oklahoma City, OK (US)

(72) Inventors: Chris White, Oklahoma City, OK (US); Jonathan Vandenfontyne, Brussels (BE); Reggie Ayers, Oklahoma City, OK (US); William J Bickel, Jr., Oklahoma City, OK (US); Chris Lawson, Oklahoma City, OK (US)

( * ) Notice: Subject to any disclaimer, the term of this patent is extended or adjusted under 35 U.S.C. 154(b) by 0 days.

(21) Appl. No.: 17/149,953

(22) Filed: Jan. 15, 2021

(65) Prior Publication Data

US 2021/0220889 A1 Jul. 22, 2021

Related U.S. Application Data

(60) Provisional application No. 62/961,992, filed on Jan. 16, 2020.

(51) Int. Cl.
*B21D 1/06* (2006.01)
*B21D 1/12* (2006.01)

(52) U.S. Cl.
CPC ..... *B21D 1/06* (2013.01); *B21D 1/12* (2013.01)

(58) Field of Classification Search
CPC . B21D 1/06; B21D 1/065; B21D 1/10; B21D 1/12
See application file for complete search history.

(56) References Cited

U.S. PATENT DOCUMENTS

| | | | | |
|---|---|---|---|---|
| 4,930,335 | A * | 6/1990 | Ishihara | B21D 1/06 72/451 |
| 5,479,804 | A | 1/1996 | Cook | |
| 6,014,885 | A | 1/2000 | Griffaton | |
| 6,722,179 | B1 * | 4/2004 | Ventura | B21D 1/06 72/454 |
| 6,957,561 | B1 | 10/2005 | Contreras | |
| 9,669,442 | B1 | 6/2017 | Alvarez | |
| 9,757,782 | B2 | 9/2017 | Wilkinson | |
| 9,868,143 | B2 | 1/2018 | Zimmerman | |
| 9,889,483 | B1 | 2/2018 | Allen | |
| 10,099,269 | B1 * | 10/2018 | Lin | B21D 1/12 |
| 10,245,629 | B1 | 4/2019 | Skelton et al. | |
| 10,252,308 | B2 | 4/2019 | Hummert | |
| 2003/0097869 | A1 * | 5/2003 | Meichtry | B21D 1/06 72/705 |

* cited by examiner

*Primary Examiner* — Teresa M Ekiert
(74) *Attorney, Agent, or Firm* — D. Ward Hobson

(57) ABSTRACT

A paintless dent removal tool, method and system for automatically removing a dent from a vehicle. The paintless dent removal tool includes a stabilizer assembly, a sleeve, a threaded chamber and a threaded rod positioned within the threaded chamber of the sleeve. Wherein, upon a rotational force being applied to the top end of the threaded rod, the threaded rod is configured to rotate within the threaded chamber raising the sleeve upwards towards the top of the stabilizer assembly, such that when a glue tab is connected to the tab connector the paintless dent removal tool automatically pulls the glue tab upward to substantially pull out the dent in the surface of the vehicle.

5 Claims, 6 Drawing Sheets

PAINTLESS DENT REMOVAL TOOL, SYSTEM AND METHOD

CROSS REFERENCE TO RELATED APPLICATIONS

This application claims priority to U.S. Provisional Application No. 62/961,992 filed on Jan. 16, 2020, which is expressly incorporated herein by reference in its entirety.

FIELD OF INVENTION

The invention is in the technical field of paintless dent removal systems, tools and methods which are used to "pull-out" dents in the outer body of a vehicle, such as an automobile, aircraft, motorcycle and the like, for example. The invention pertains generally to modular paintless dent removal systems, tools, and methods. In some embodiments, the paintless dent removal tool may be configured to be detachably connected to an automatic hand-held tool, such as an automatic drill, for example, while in other embodiments, the paintless dent removal tool may be configured to be detachably connected to a manual lever, for example. Further, in some embodiments, the paintless dent removal tool may be configured to be used with one or more base for stabilizing the paintless dent removal tool on a surface of a vehicle. Likewise, in some embodiments, the paintless dent removal system and paintless dent removal tool may each be configured to be detachably connected to a plurality of paintless dent removal tools or a plurality of paintless dent removal systems, so as to increase the strength of the paintless dent removal system and paintless dent removal tool and depending upon the size and shape of the dent to be removed. Likewise, the paintless dent removal tool is also configured to be used with a variety of different sized and different shaped glue tabs for removing a variety of different sized and shaped dents. Each component part of the paintless dent removal tool and the paintless dent removal system is configured to be used together as an interchangeable system.

BACKGROUND

Advancements in construction methods and materials have resulted in lighter and stronger vehicle bodies for automobiles, aircrafts, motorcycles and the like. However, such improved vehicle bodies are often increasingly prone to dents, dings and various other body deformations. Such damage may be caused by, for example, automobile accidents or debris striking the outer surface of the vehicle body. Removing such dents, dings and deformations can be difficult, laborious and time consuming, even when using traditional paintless dent removal tools and processes.

In general, paintless dent removal is the process of removing dents from the body of a vehicle body without repainting the vehicle. Thus, saving the owner of the vehicle time and money by avoiding the cost and expense of repainting the vehicle. Traditionally, in paintless dent removal, many removal shops utilize the flexibility and durability of the outer surface of the vehicle body to reach into vehicle body compartments to "push-out" a dent from the inside outward or "pull-out" a dent from the outside of the vehicle body. Once the dent is pushed or pulled out, there is also a need to partially "knock-down" or flatten the dent to smooth-out the outer surface of the vehicle body to completely remove the dent.

Traditionally, dent removal shops have used a variety of tools to help assist a user with the paintless dent removal process, including tools designed to assist a user with the "push-out" and "pull-out" process and tools designed to assist a user with the "knock-down" process, for example. Unfortunately, however, such traditional tools are inefficiently configured, difficult to use and difficult to control. Thus, decreasing their usefulness and increasing the overall cost of the paintless dent removal process. To that end, it would be advantageous to provide an improved paintless dent removal tool, system and method configured to more efficiently "pull-out" dents from the surface of a vehicle body to increase the effectiveness and reduce the cost of the paintless dent removal process.

SUMMARY OF THE INVENTION

The inventive concepts disclosed herein are generally directed to a modular paintless dent removal system, paintless dent removal tools and methods of use. The paintless dent removal system and paintless dent removal tools, are configured to be detachably connected to one another in a variety of configurations. In this way, the paintless dent removal system, paintless dent removal tools and methods of use are configured to be used to remove a variety of different sized and different shaped dents. In addition, because the various components of the paintless dent removal system and paintless dent removal tools are modular, one part may be substituted or replaced with another part without having to replace the entire paintless dent removal system or replace the entire paintless dent removal tool.

In some embodiments, the paintless dent removal tool may be configured to be detachably connected to an automatic hand-held tool, such as an automatic drill, for example, while in other embodiments, the paintless dent removal tool may be configured to be detachably connected to a manual lever, for example. Further, in some embodiments, the paintless dent removal tool may be configured to be used with one or more base for stabilizing the paintless dent removal tool on a surface of a vehicle. Likewise, in some embodiments, the paintless dent removal system and paintless dent removal tool may each be configured to be detachably connected to a plurality of paintless dent removal tools or a plurality of paintless dent removal systems, so as to increase the strength of the paintless dent removal system and paintless dent removal tool and depending upon the size and shape of the dent to be removed. Likewise, the paintless dent removal tool is also configured to be used with a variety of different sized and different shaped glue tabs for removing a variety of different sized and shaped dents. Each component part of the paintless dent removal tool and the paintless dent removal system is configured to be modular and interchangeable so that the paintless dent removal system may be configured to be used with a variety of different sized and different shaped parts depending upon the type and size of the dent to be removed.

In some embodiments, the paintless dent removal tool includes a stabilizer assembly having a top, bottom, first leg, second leg and a body extending therebetween. The body having an opening extending between the top of the stabilizer assembly and the bottom of the stabilizer assembly. The paintless dent removal tool further including a sleeve having a first end, a second end having a tab connector connected thereto, and a threaded chamber extending between the first end and the second end. The sleeve positioned within the opening of the stabilizer assembly and connected thereto. The paintless dent removal tool further including a threaded rod positioned within the threaded chamber of the sleeve. The threaded rod having a top end extending out from the top of the stabilizer assembly and a bottom end rotatably engaged with the threaded chamber of the sleeve. The paintless dent removal tool including one or more base detachably connected to the first leg and detachably connected to the second leg. The paintless dent removal tool including a top member rotatably engaged with the top of the stabilizer assembly. The top member having an opening extending therethrough for receiving the threaded rod. Wherein, upon a rotational force being applied to the top end of the threaded rod, the threaded rod is configured to rotate within the threaded chamber raising the sleeve upwards towards the top of the stabilizer assembly such that when a glue tab is connected to the tab connector, the paintless dent removal tool automatically pulls the glue tab upward to substantially pull out the dent in the surface of the vehicle.

In some embodiments, the stabilizer assembly of the paintless dent removal tool is substantially Y-shaped. Further, in some embodiments, the rotational force is applied to the top end of the threaded rod by means of an automatic drill. In some embodiments, the one or more base has a rectangular shape, while in some embodiments the one or more base has a substantially round shape. Further, in some embodiments, the one or more base may further include one or more socket for receiving the first leg and one or more socket for receiving the second leg of the stabilizer assembly. While in some embodiments, the first leg and the second leg are rounded.

The inventive concepts disclosed herein further include a method of removing a dent from a vehicle. The method including the steps of: (a) providing a paintless dent removal tool for removing a dent from a vehicle. The paintless dent removal tool including a stabilizer assembly having a top, bottom, first leg, second leg and a body extending therebetween. The body having an opening extending between the top of the stabilizer assembly and the bottom of the stabilizer assembly. The paintless dent removal tool including a sleeve having a first end, a second end having a tab connector extending therefrom, and a threaded chamber extending between the first end and the second end. The sleeve positioned within the opening of the stabilizer assembly and connected thereto. The paintless dent removal tool including a threaded rod positioned within the threaded chamber of the sleeve. The threaded rod having a top end extending out from the top of the stabilizer assembly and a bottom end rotatably engaged with the threaded chamber of the sleeve. The paintless dent removal tool including one or more base detachably connected to the first leg and detachably connected to the second leg of the stabilizer assembly. The paintless dent removal tool including a top member rotatably engaged with the top of the stabilizer assembly. The top member having an opening extending therethrough for receiving the threaded rod. The method of removing a dent from a vehicle further including the step of: (b) positioning the stabilizer assembly of the paintless dent removal tool on the surface of the vehicle such that the dent is positioned between the first leg of the stabilizer assembly and the second leg of the stabilizer assembly. The method of removing a dent from a vehicle further including the steps of: (c) affixing a glue tab to the dent on the surface of the vehicle; and (d) connecting the tab connector of the paintless dent removal tool to the glue tab. The method of removing a dent from a vehicle further including the steps of: (e) connecting an automatic drill to the top end of the threaded rod; and (e) automatically pulling the glue tab upward to substantially pull out the dent in the surface of the vehicle.

The inventive concepts disclosed herein further include a paintless dent removal system for removing a dent from a vehicle. The paintless dent removal system including a first paintless dent removal tool. The first paintless dent removal tool including a stabilizer assembly having a top, bottom, first leg, second leg and a body extending therebetween. The body having an opening extending between the top of the stabilizer assembly and the bottom of the stabilizer assembly. The first paintless dent removal tool further including a threaded rod positioned within the opening of the stabilizer assembly and connected thereto. The threaded rod having a top end and a bottom end. The bottom end having a tab connector detachably connected thereto. The first paintless dent removal tool further includes one or more base detachably connected to the first leg and detachably connected to the second leg of the stabilizer assembly. The first paintless dent removal tool further includes a top member rotatably engaged with the top of the stabilizer assembly. The top member having a lever for raising the threaded rod upward. Wherein, upon use of the lever by a user, the threaded rod is configured to raise the threaded rod upward such that when a glue tab is connected to the tab connector, the paintless dent removal tool pulls the glue tab upward to substantially pull out the dent in the surface of the vehicle.

The paintless dent removal system further includes a second paintless dent removal tool. The second paintless dent removal tool including a stabilizer assembly having a top, bottom, first leg, second leg and a body extending therebetween. The body having an opening extending between the top of the stabilizer assembly and the bottom of the stabilizer assembly. The second paintless dent removal tool including a threaded rod positioned within the opening of the stabilizer assembly and connected thereto. The threaded rod having a top end and a bottom end. The bottom end having a tab connector detachably connected thereto. The second paintless dent removal tool including one or more base detachably connected to the first leg and detachably connected to the second leg of the stabilizer assembly. The second paintless dent removal tool including a top member rotatably engaged with the top of the stabilizer assembly. The top member having a lever for raising the threaded rod upward. Wherein, upon use of the lever by a user, the threaded rod is configured to raise the threaded rod upward such that when a glue tab is connected to the tab connector, the paintless dent removal tool pulls the glue tab upward to substantially pull out the dent in the surface of the vehicle.

It is to such an improved paintless dent removal system, tools and to methods of using thereof that exemplary embodiments of the inventive concepts disclosed and claimed herein are directed.

BRIEF DESCRIPTION OF THE SEVERAL VIEWS OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 1:
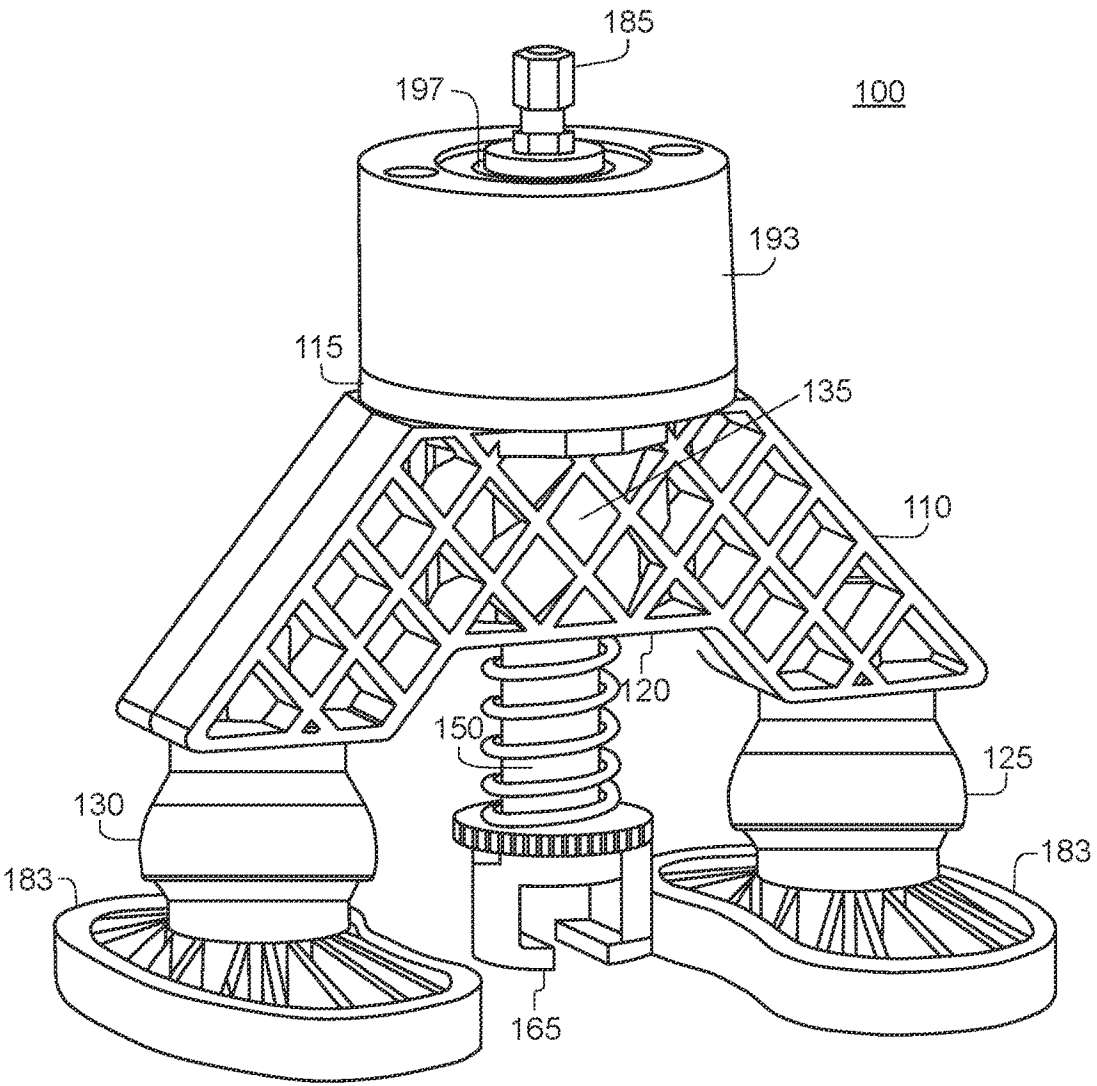
FIG. 1 is a perspective view of an embodiment of a paintless dent removal tool (100) in accordance with the inventive concepts disclosed herein.

Before explaining at least one embodiment of the inventive concepts disclosed herein in detail, it is to be understood that the inventive concepts are not limited in their application to the details of construction and the arrangements of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting the inventive concepts claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

As used herein, the terms "comprises," "comprising," "includes," "including," "has." "having," or any other variation thereof, are intended to cover a non-exclusive inclusion. For example, a process, method, article, or apparatus that comprises a list of elements is not necessarily limited to only those elements but may include other elements not expressly listed.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 3:
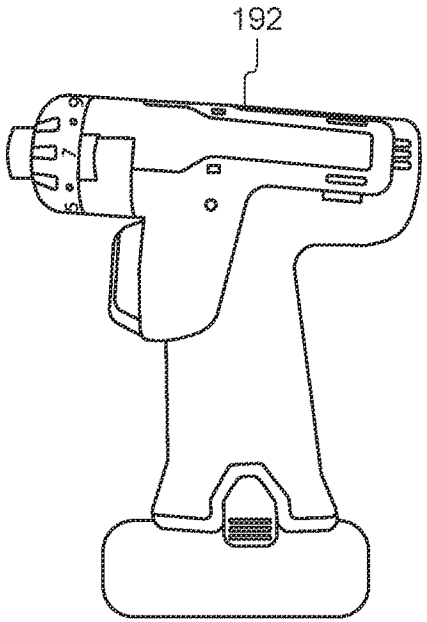
FIG. 3 is a perspective view of an automatic drill (192) configured to be used with embodiments of the paintless dent removal tool (100) in accordance with the inventive concepts disclosed herein.
Figure 2:
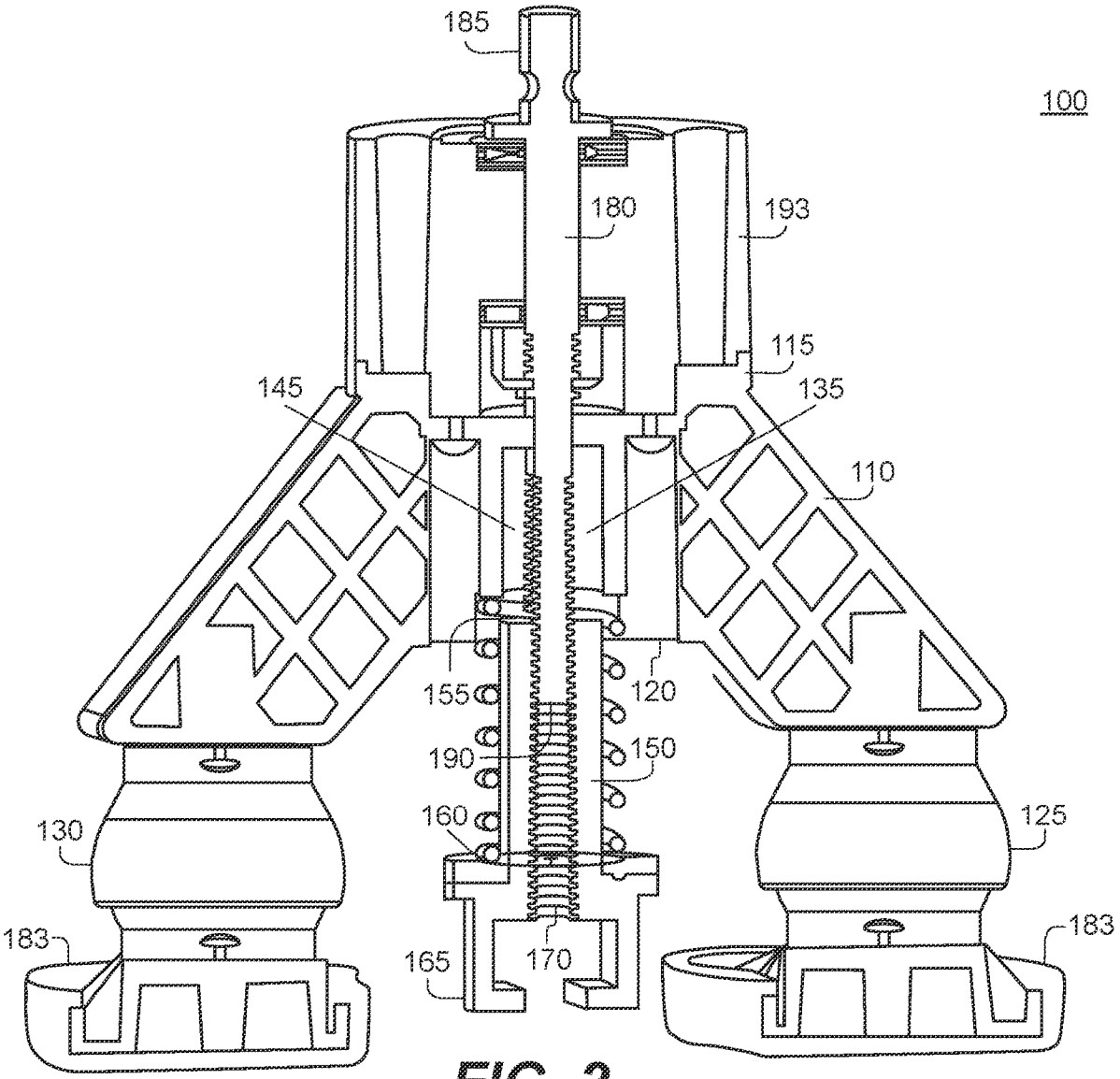
FIG. 2 is a perspective sectional view of the paintless dent removal tool (100) of FIG. 1 in accordance with the inventive concepts disclosed herein.

Referring now to FIGS. 1-3, shown therein is a paintless dent removal tool (100) for removing a dent (105) from a vehicle. FIG. 1 is a perspective view of an embodiment of a paintless dent removal tool (100) in accordance with the inventive concepts disclosed herein. FIG. 2 is a perspective sectional view of the paintless dent removal tool (100) of FIG. 1 in accordance with the inventive concepts disclosed herein. FIG. 3 is a perspective view of an automatic drill (192) configured to be used with embodiments of the paintless dent removal tool (100) in accordance with the inventive concepts disclosed herein.

As shown therein, the paintless dent removal tool (100) includes a stabilizer assembly (110) having a top (115), bottom (120), first leg (125), second leg (130) and a body (135) extending therebetween. The body (135) having an opening (145) extending between the top (115) of the stabilizer assembly (110) and the bottom (120) of the stabilizer assembly (110). The paintless dent removal tool (100) including a sleeve (150) having a first end (155), a second end (160) having a tab connector (165) extending therefrom, and a threaded chamber (170) extending between the first end (155) and the second end (160). The sleeve (150) positioned within the opening (145) of the stabilizer assembly (110) and connected thereto. The paintless dent removal tool (100) includes a threaded rod (180) positioned within the threaded chamber (170) of the sleeve (150). The threaded rod (180) having a top end (185) extending out from the top (115) of the stabilizer assembly (110) and a bottom end (190) rotatably engaged with the threaded chamber (170) of the sleeve (150).

The paintless dent removal tool (100) further includes one or more base (183) detachably connected to the first leg (125) and detachably connected to the second leg (130). The paintless dent removal tool (100) further including a top member (193) rotatably engaged with the top (115) of the stabilizer assembly (110), the top member (193) having an opening (197) extending therethrough for receiving the threaded rod (180).

Wherein, upon a rotational force being applied to the top end (185) of the threaded rod (180), the threaded rod (180) is configured to rotate within the threaded chamber (170) raising the sleeve (150) upwards towards the top (115) of the stabilizer assembly (110) such that when a glue tab (190) is connected to the tab connector (165), the paintless dent removal tool (100) automatically pulls the glue tab (190) upward to substantially pull out the dent (105) in the surface of the vehicle.

In some embodiments, the rotational force is applied to the top end (185) of the treaded rod (180) by means of an automatic drill (192). However, it should be understood that the rotational force may be applied by any device known in the art. In some embodiments the stabilizer assembly (110) is substantially Y-shaped. In some embodiments the one or more base (183) has a rectangular shape, while in some embodiments the one or more base (183) has a substantially round shape, for example. Further, in some embodiments the one or more base (183) has one or more socket (126) for receiving the first leg (125) and one or socket (126) for receiving the second leg (130) of the stabilizer assembly (110). Further, in some embodiments, the first leg (125) and the second leg (130) are rounded.

The paintless dent removal tool (100) may be constructed from any material of sufficient strength necessary to maintain the structural integrity of the paintless dent removal tool (100) when in use. For example, the paintless dent removal tool (100) may be constructed from non-metals such as plastics, polycarbonate, impact resistant nylon, carbon fiber, polymers, resins, ceramics, composite materials and the like or metals and alloys, including steel, titanium, iron, combinations thereof and the like. Further, it should be understood that the various components of the paintless dent removal tool (100) may each be constructed from the same or different materials, combinations thereof and the like.

The paintless dent removal tool (100) is shown as having a generally Y shape. It should be understood, however, that the paintless dent removal tool (100) may have any desired shape, including but not limited to, a generally triangular, rectangular, square or circular shape for example. Further, each component of the paintless dent removal tool (100) may have the same or different shape, including, but not limited to a triangular, rectangular or circular shape for example. For example, in some embodiments, the stabilizer assembly (110) of the paintless dent removal tool (100) is also substantially Y-shaped.

The stabilizer assembly (110) has a top (115), bottom (120), first leg (125), second leg (130) and a body (135) extending therebetween. The body (135) having an opening (145) extending between the top (115) of the stabilizer assembly (110) and the bottom (120) of the stabilizer assembly (110). The stabilizer assembly (110) configured for stabilizing the paintless dent removal tool (100) on a surface of the vehicle. In some embodiments, the stabilizer assembly (110) of the paintless dent removal tool (100) is substantially Y-shaped.

As discussed above, the stabilizer assembly (110) may be constructed from any material of sufficient strength necessary to maintain the structural integrity of the paintless dent removal tool (100) when in use. For example, the stabilizer assembly (110) may be constructed from non-metals such as plastics, polycarbonate, impact resistant nylon, carbon fiber, polymers, resins, ceramics, composite materials and the like or metals and alloys, including steel, titanium, iron, combinations thereof and the like. Further, it should be understood that various components of the stabilizer assembly (110) may each be constructed from the same or different materials, combinations thereof and the like for example.

Further, while the stabilizer assembly (110) is shown as having a generally Y shape, it should be understood that the stabilizer assembly (110) may have any desired shape, including but not limited to, a generally triangular, rectangular, square or circular shape for example. Further, each component of the stabilizer assembly (110) may have the same or different shape, including, but not limited to a Y, triangular, rectangular or circular shape for example.

The sleeve (150) has a first end (155), a second end (160) having a tab connector (165) extending therefrom, and a threaded chamber (170) extending between the first end (155) and the second end (160), the sleeve (150) positioned within the opening (145) of the stabilizer assembly (110) and connected thereto.

As discussed above, the sleeve (150) may be constructed from any material of sufficient strength necessary to maintain the structural integrity of the paintless dent removal tool (100) when in use. For example, the sleeve (150) may be constructed from non-metals such as plastics, polycarbonate, impact resistant nylon, carbon fiber, polymers, resins, ceramics, composite materials and the like or metals and alloys, including steel, titanium, iron, combinations thereof and the like. Further, it should be understood that various components of the sleeve (150) may each be constructed from the same or different materials, combinations thereof and the like for example.

Further, while the sleeve (150) is shown as having a generally rectangular shape, it should be understood that the sleeve (150) may have any desired shape, including but not limited to, a generally square, circular or triangular shape for example. Further, each component of the sleeve (150) may have the same or different shape, including, but not limited to a triangular, rectangular or circular shape for example.

The tab connector (165) is configured to detachably connect and disconnect to a glue tab. Traditional glue tab tools generally have a top member, a neck member and a flexible bottom member. Traditional glue tabs are configured so that the flexible bottom member is affixed to a dent with glue and the top member is pulled upward by a user or machine to pull-out a dent in the vehicle body. The tab connector (165) is configured to permit a traditional glue tab to connect and disconnect thereto by sliding the top member of the glue tab into the tab connector (165). It should be understood, however, that a glue tab may be connected and disconnected to the tab connector (165) by any means, including but not limited to, screws, bolts, pins, adhesives, locking mechanisms, magnets, combinations thereof and the like for example. Further, the tab connector (165) may be used with tools other than traditional glue tabs that are configured to be affixed to a vehicle surface and pulled upward by a person or machine.

The threaded rod (180) is positioned within the threaded chamber (170) of the sleeve (150). The threaded rod (180) includes a top end (185) extending out from the top (115) of the stabilizer assembly (110) and a bottom end (190) rotatably engaged with the threaded chamber (170) of the sleeve (150). The threaded rod (180) may be constructed from any material of sufficient strength necessary to maintain the structural integrity of the paintless dent removal tool (100) when in use. For example, the threaded rod (180) may be constructed from metals and alloys, including steel, titanium, iron, combinations thereof and the like or non-metals such as plastics, polycarbonate, impact resistant nylon, carbon fiber, polymers, resins, ceramics, composite materials and the like.

The one or more base (183) is detachably connected to the first leg (125) and detachably connected to the second leg (130). The one or more base may be constructed from any material of sufficient strength necessary to maintain the structural integrity of the paintless dent removal tool (100) when in use. For example, the one or more base (183) may be constructed from non-metals such as plastics, polycarbonate, impact resistant nylon, carbon fiber, polymers, resins, ceramics, composite materials and the like or metals and alloys, including steel, titanium, iron, combinations thereof and the like. Further, it should be understood that various components of the one or more base (183) may each be constructed from the same or different materials, combinations thereof and the like for example.

The top member (193) is rotatably engaged with the top (115) of the stabilizer assembly (110). The top member (193) having an opening (197) extending therethrough for receiving the threaded rod (180). The top member (193) may be constructed from any material of sufficient strength necessary to maintain the structural integrity of the paintless dent removal tool (100) when in use. For example, the top member (193) may be constructed from non-metals such as plastics, polycarbonate, impact resistant nylon, carbon fiber, polymers, resins, ceramics, composite materials and the like or metals and alloys, including steel, titanium, iron, combinations thereof and the like. Further, it should be understood that various components of the top member (193) may each be constructed from the same or different materials, combinations thereof and the like for example.

Wherein, upon a rotational force being applied to the top end (185) of the threaded rod (180), the threaded rod (180) is configured to rotate within the threaded chamber (170) raising the sleeve (150) upwards towards the top (115) of the stabilizer assembly (110) such that when a glue tab (190) is connected to the tab connector (165), the paintless dent removal tool (100) automatically pulls the glue tab (190) upward to substantially pull out the dent (105) in the surface of the vehicle.

Figure 5:
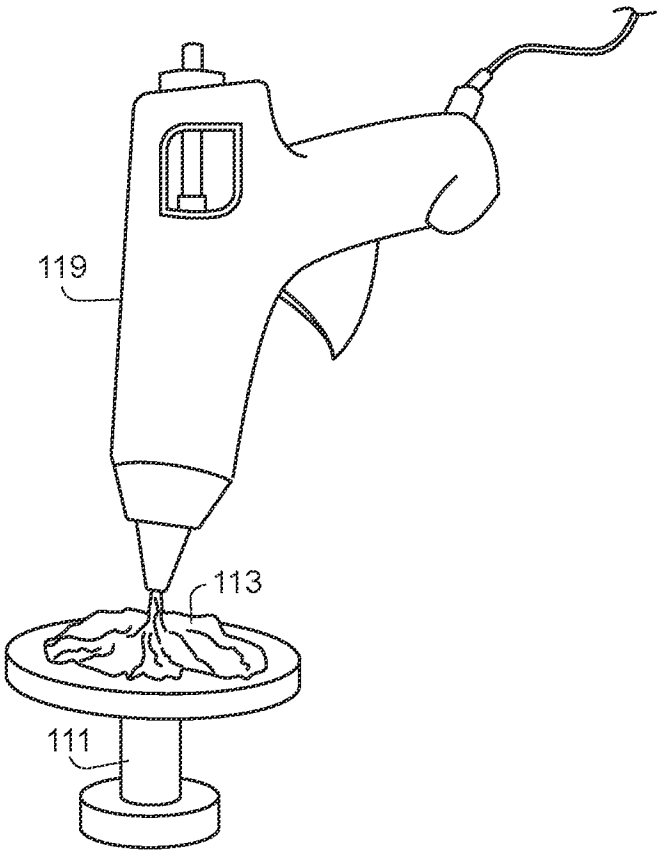
FIG. 5 is a perspective view of a glue gun (119) shown applying glue (113) to a glue tab (111) in accordance with the inventive concepts disclosed herein.
Figure 4:
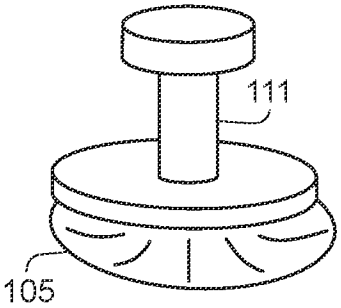
FIG. 4 is a perspective view of a glue tab (111) positioned above a dent (105) in accordance with the inventive concepts disclosed herein.
Figure 6:
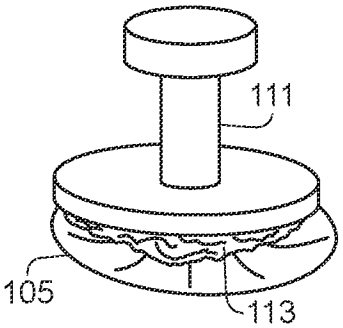
FIG. 6 is a perspective view of a glue tab (111) positioned above a dent (105) in accordance with the inventive concepts disclosed herein.

Referring now to FIGS. 4-6, shown therein are perspective views of a glue tab (111). FIG. 4 is a perspective view of a glue tab (111) positioned above a dent (105) in accordance with the inventive concepts disclosed herein. FIG. 5 is a perspective view of a glue gun (119) shown applying glue (113) to a glue tab (111) in accordance with the inventive concepts disclosed herein. FIG. 6 is a perspective view of a glue tab (111) positioned above a dent (105) in accordance with the inventive concepts disclosed herein. As discussed above, traditional glue tabs generally have a top member, a neck member and a flexible bottom member. Traditional glue tabs are configured so that the flexible bottom member is affixed to a dent with glue (by a glue gun for example) and the top member is pulled upward by a user (either by hand or by a machine) to pull-out a dent in the vehicle body.

Figure 7:
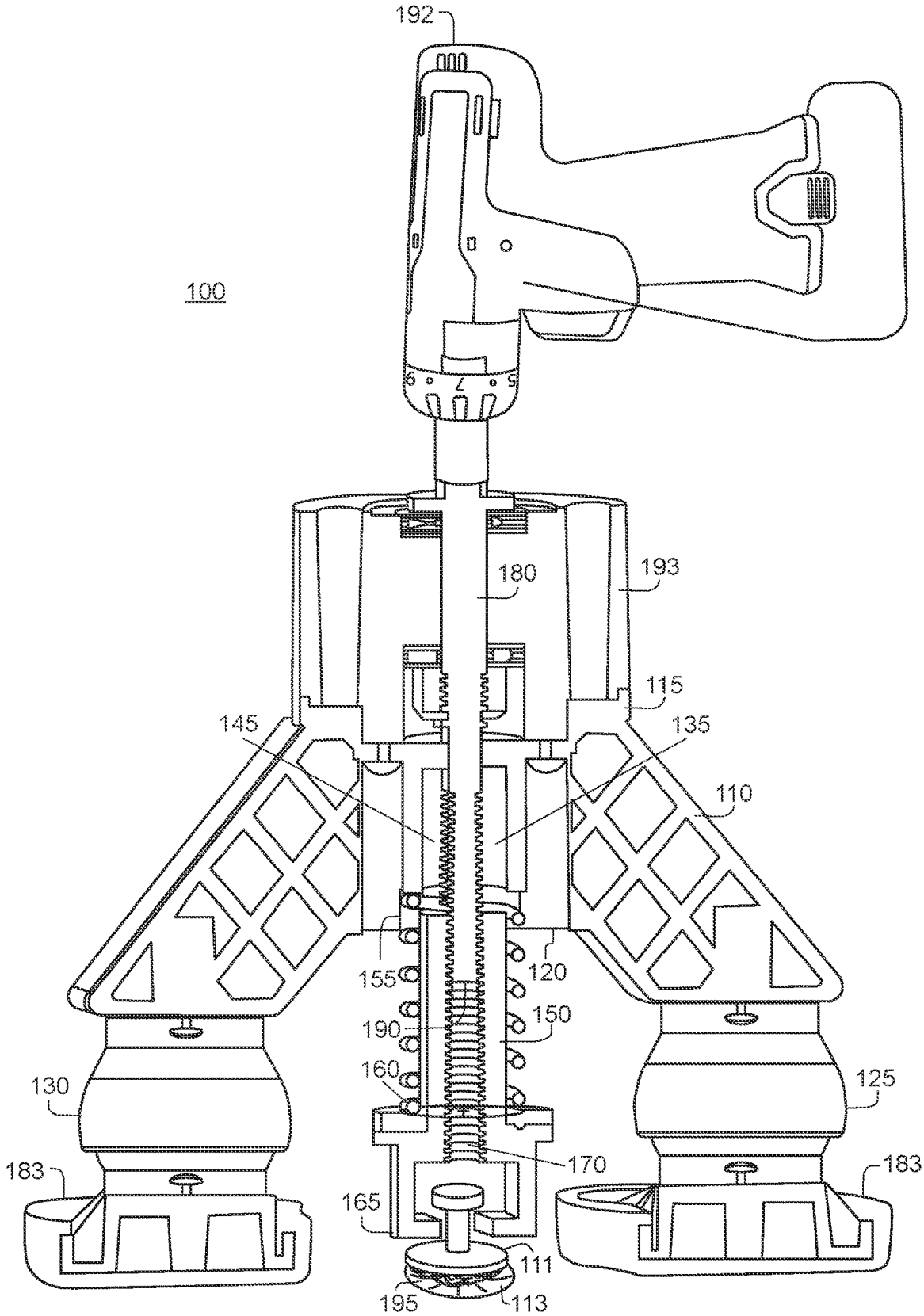
FIG. 7 is a perspective view of an embodiment of a paintless dent removal tool (100) used in combination with an automatic drill (192) to pull out a dent (105) in a surface of vehicle in accordance with the inventive concepts disclosed herein.

Referring now to FIG. 7, shown therein is a perspective view of an embodiment of a paintless dent removal tool (100) used in combination with an automatic drill (192) to pull out a dent (105) in a surface of vehicle in accordance with the inventive concepts disclosed herein. As shown therein, the paintless dent removal tool (100) includes a stabilizer assembly (110) having a top (115), bottom (120), first leg (125), second leg (130) and a body (135) extending therebetween. The body (135) having an opening (145) extending between the top (115) of the stabilizer assembly (110) and the bottom (120) of the stabilizer assembly (110). The stabilizer assembly (110) for stabilizing the paintless dent removal tool (100) on a surface of a vehicle. The paintless dent removal tool (100) including a sleeve (150) having a first end (155), a second end (160) having a tab connector (165) extending therefrom, and a threaded chamber (170) extending between the first end (155) and the second end (160). The sleeve (150) positioned within the opening (145) of the stabilizer assembly (110) and connected thereto. The paintless dent removal tool (100) further including a threaded rod (180) positioned within the threaded chamber (170) of the sleeve (150). The threaded rod (180) having a top end (185) extending out from the top (115) of the stabilizer assembly (110) and a bottom end (190) rotatably engaged with the threaded chamber (170) of the sleeve (150). Wherein, upon a rotational force being applied to the top end (185) of the threaded rod (180), the threaded rod (180) is configured to rotate within the threaded chamber (170) raising the sleeve (150) upwards towards the top (115) of the stabilizer assembly (110) such that when a glue tab (190) is connected to the tab connector (165), the paintless dent removal tool (100) automatically pulls the glue tab (190) upward to substantially pull out the dent (105) in the surface of the vehicle.

Figure 8:
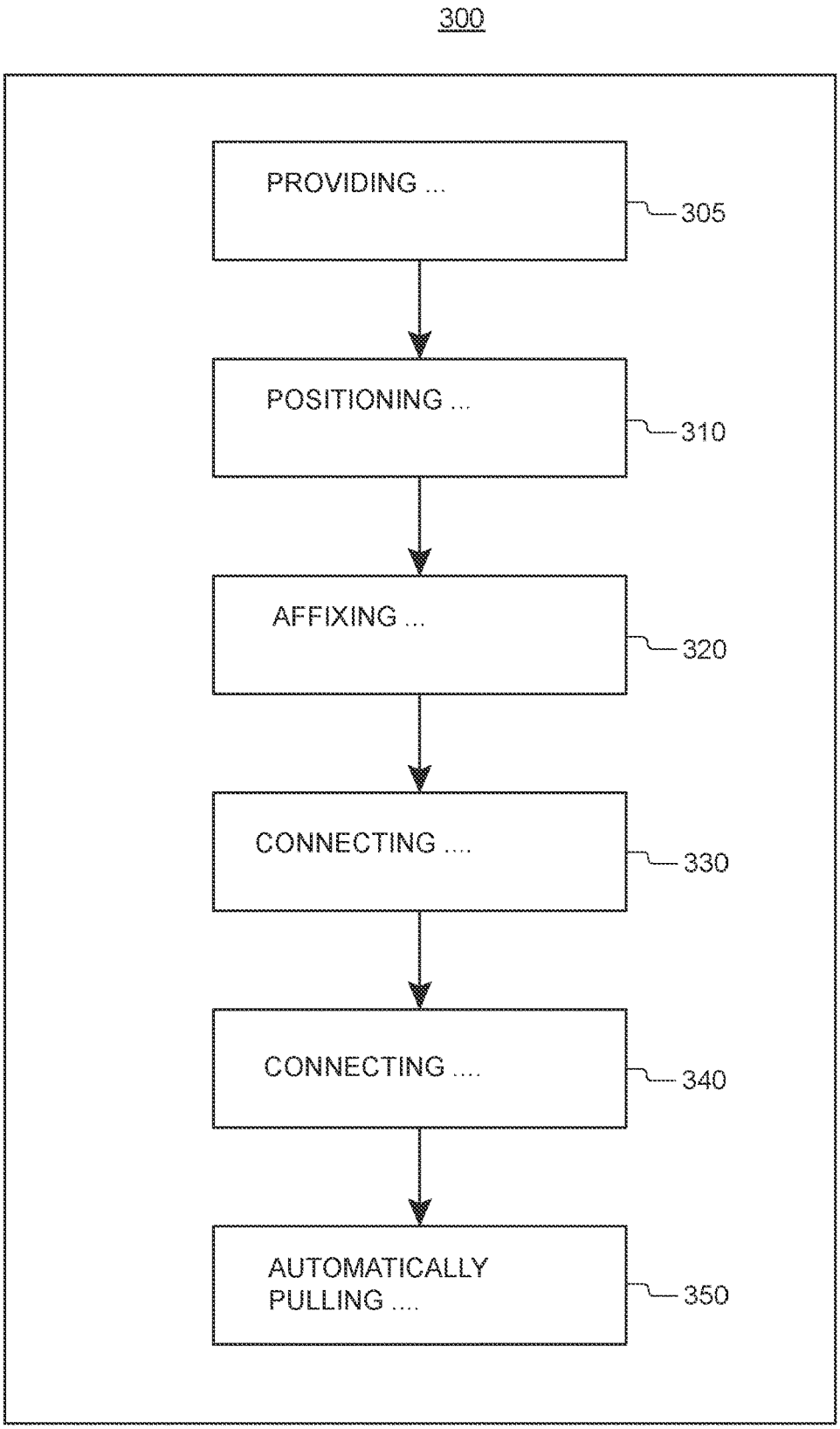
FIG. 8 depicts a method (300) of removing a dent from a vehicle in accordance with the inventive concepts disclosed herein.

Referring now to FIG. 8, shown therein is a method (300) of removing a dent (105) from a vehicle in accordance with the inventive concepts disclosed herein. The method (300) including the step of providing (305) a paintless dent removal tool (100) for removing a dent (105) from a vehicle. The paintless dent removal tool (100) including a stabilizer assembly (110) having a top (115), bottom (120), first leg (125), second leg (130) and a body (135) extending therebetween. The body (140) having an opening (145) extending between the top (115) of the stabilizer assembly (110) and the bottom (120) of the stabilizer assembly (110). The stabilizer assembly (110) for stabilizing the paintless dent removal tool (100) on a surface of a vehicle. The paintless dent removal tool (100) including a sleeve (150) having a first end (155), a second end (160) having a tab connector (165) extending therefrom, and a threaded chamber (170) extending between the first end (155) and the second end (160). The sleeve (150) positioned within the opening (145) of the stabilizer assembly (110) and connected thereto. The paintless dent removal tool (100) further includes a threaded rod (180) positioned within the threaded chamber (170) of the sleeve (150). The threaded rod (180) having a top end (185) extending out from the top (115) of the stabilizer assembly (110) and a bottom end (190) rotatably engaged with the threaded chamber (170) of the sleeve (150). The paintless dent removal tool (100) further including one or more base (183) detachably connected to the first leg (125) and detachably connected to the second leg (130) of the stabilizer assembly (110). The paintless dent removal tool (100) further including a top member (193) rotatably engaged with the top (115) of the stabilizer assembly (110), the top member (193) having an opening (197) extending therethrough for receiving the threaded rod (180).

The method (300) further including the step of positioning (310) the stabilizer assembly (110) of the paintless dent removal tool (100) on the surface of the vehicle such that the dent (105) is positioned between the first leg (125) of the stabilizer assembly (110) and the second leg (130) of the stabilizer assembly (110). The method (300) further includes the step of affixing (320) a glue tab (111) to the dent (105) on the surface of the vehicle and the step of connecting (330) the tab connector (165) of the paintless dent removal tool (100) to the glue tab (190). Further, the method (300) further includes connecting (340) an automatic drill (192) to the top end (185) of the threaded rod (180) and the step of automatically pulling (350) the glue tab (111) upward to substantially pull out the dent (105) in the surface of the vehicle.

Figure 9:
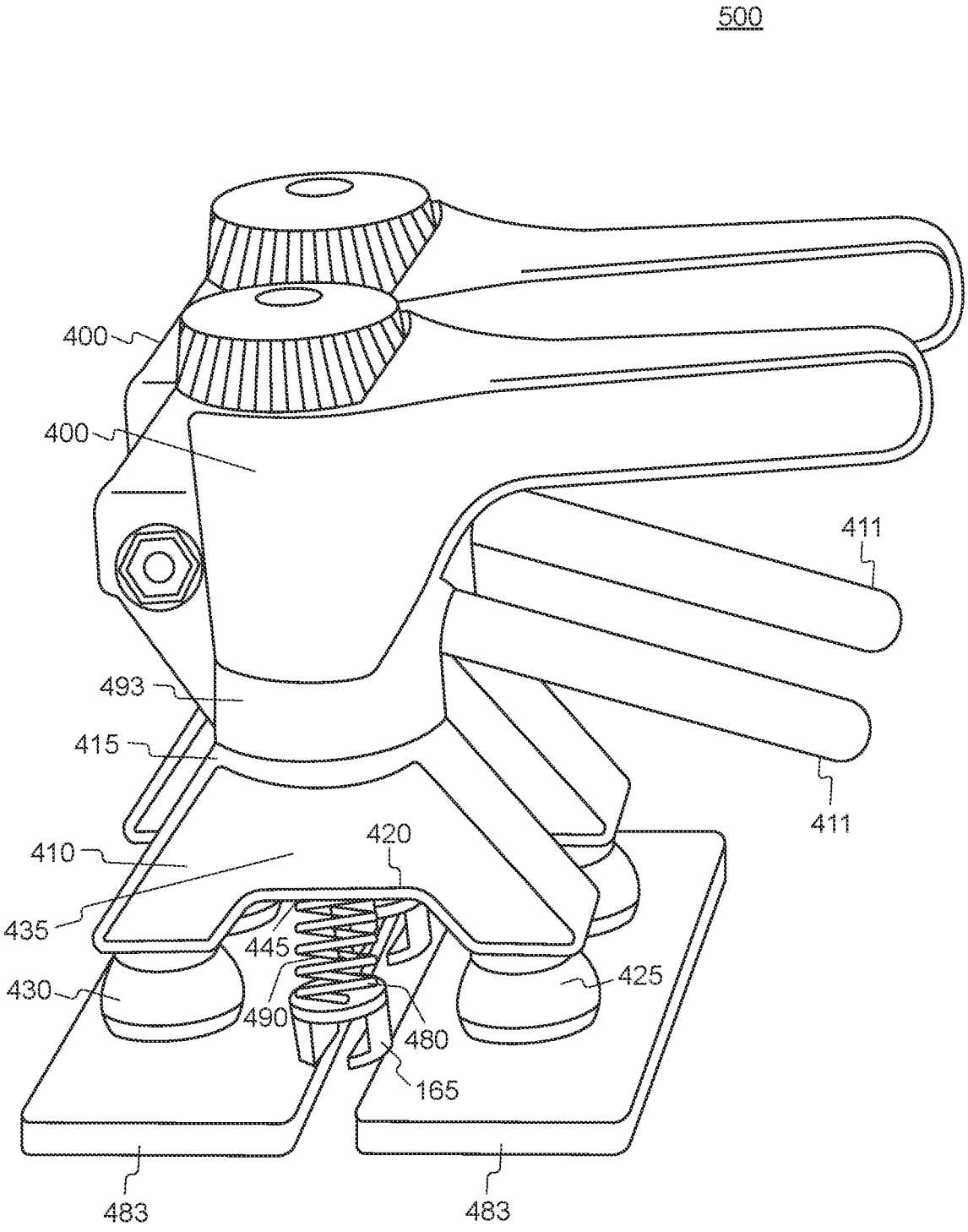
FIG. 9 depicts a perspective view of a paintless dent removal system (500) in accordance with the inventive concepts disclosed herein.

Referring now to FIG. 9 shown therein is a paintless dent removal system (500) for removing a dent (105) from a vehicle. The paintless dent removal system (500) includes a first paintless dent removal tool (400). The first paintless dent removal tool (400) includes a stabilizer assembly (410) having a top (415), bottom (420), first leg (425), second leg (430) and a body (435) extending therebetween. The body (435) having an opening (445) extending between the top (415) of the stabilizer assembly (410) and the bottom (420) of the stabilizer assembly (410). The first paintless dent removal tool (400) includes a threaded rod (480) positioned within the opening (445) of the stabilizer assembly (410) and connected thereto. The threaded rod (480) having a top end (485) and a bottom end (490). The bottom end (490) having a tab connector (165) detachably connected thereto. The first paintless dent removal tool (400) further includes one or more base (483) detachably connected to the first leg (425) and detachably connected to the second leg (430) of the stabilizer assembly (410). The first paintless dent removal tool (400) includes a top member (493) rotatably engaged with the top (415) of the stabilizer assembly (410). The top member (493) having a lever (411) for raising the threaded rod (480) upward. Wherein, upon use of the lever (411) by a user, the threaded rod (480) is configured to raise the threaded rod (480) upward such that when a glue tab (111) is connected to the tab connector (465), the paintless dent removal tool (400) pulls the glue tab (111) upward to substantially pull out the dent (105) in the surface of the vehicle.

In some embodiments, the paintless dent removal system (500) further includes a second paintless dent removal tool (400). The second paintless dent removal tool (400) includes a stabilizer assembly (410) having a top (415), bottom (420), first leg (425), second leg (430) and a body (435) extending therebetween. The body (435) having an opening (445) extending between the top (415) of the stabilizer assembly (410) and the bottom (420) of the stabilizer assembly (410). The second paintless dent removal tool includes a threaded rod (480) positioned within the opening (445) of the stabilizer assembly (410) and connected thereto. The threaded rod (480) having a top end (485) and a bottom end (490). The bottom end (490) having a tab connector (165) detachably connected thereto. The second paintless dent removal tool (400) further includes one or more base (183) detachably connected to the first leg (125) and detachably connected to the second leg (130) of the stabilizer assembly (110). The second paintless dent removal tool (400) includes a top member (493) rotatably engaged with the top (415) of the stabilizer assembly (410). The top member (493) having a lever (411) for raising the threaded rod (480) upward. Wherein, upon use of the lever (411) by a user, the threaded rod (480) is configured to raise the threaded rod (480) upward such that when a glue tab (111) is connected to the tab connector (465), the paintless dent removal tool (400) putls the glue tab (111) upward to substantially pull out the dent (105) in the surface of the vehicle.

Similarly to the paintless dent removal tool (100) described above, the paintless dent removal system (500) may be constructed from the same and like materials. For example, the paintless dent removal system (500) may be constructed from any material of sufficient strength necessary to maintain the structural integrity of the paintless dent removal system (500) when in use. For example, the paintless dent removal system (500) may be constructed from non-metals such as plastics, polycarbonate, impact resistant nylon, carbon fiber, polymers, resins, ceramics, composite materials and the like or metals and alloys, including steel, titanium, iron, combinations thereof and the like. Further, it should be understood that various components of the paintless dent removal system (500) may each be constructed from the same or different materials, combinations thereof and the like for example.

It is to be appreciated that embodiments of the inventive concepts disclosed herein may be shipped fully or partially assembled, or fully or partially disassembled in the form of a kit, as will be readily appreciated by persons of ordinary skill in the art having the benefit of the instant disclosure.

From the above description, it is clear that the inventive concepts disclosed herein are adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the broad scope of the inventive concepts disclosed herein and defined by the appended claims.

What is claimed is:

1. A modular paintless dent removal tool for removing a dent from a vehicle, the modular paintless dent removal tool comprising:

a detachably removable stabilizer assembly having a top, bottom, rounded first leg, rounded second leg and a body extending therebetween, the body having an opening extending between the top of the stabilizer assembly and the bottom of the stabilizer assembly;

a detachably removable sleeve having a first end, a second end having a tab connector extending therefrom, and a threaded chamber extending between the first end and the second end, the sleeve positioned within the opening of the stabilizer assembly and connected thereto;

a glue tab detachably connected to the tab connector, the glue tab having a top member, a neck member, and a flexible bottom member, the glue tab configured to be detachably affixed to the dent on the vehicle, a detachably removable threaded rod positioned within the threaded chamber of the sleeve, the threaded rod having a top end extending out from the top of the stabilizer assembly and a bottom end rotatably engaged with the threaded chamber of the sleeve;

one or more detachably removable rounded base detachably connected to the rounded first leg and detachably connected to the rounded second leg, the one or more base having one or more socket for receiving the rounded first leg and the rounded second leg of the stabilizer assembly, such that the rounded first leg and the rounded second leg selectively rotate within the socket so that the modular paintless dent removal tool may be positioned on a curved surface of the vehicle:

a detachably removable top member rotatably engaged with the top of the stabilizer assembly, the top member having an opening extending therethrough for receiving the threaded rod;

a detachably removable automatic drill detachably connected to the threaded rod, the automatic drill having a chuck for receiving the top end of the threaded rod wherein, upon a rotational force being applied to the top end of the threaded chamber by the automatic drill, the sleeve is raised upwards towards the top of the stabilizer assembly such that when the glue tab is connected to the tab connector, the paintless dent removal tool automatically pulls the glue tab upward to substantially pull out the dent in the surface of the vehicle.

2. The paintless dent removal tool of claim 1, wherein the stabilizer assembly is substantially Y-shaped.

3. The paintless dent removal tool of claim 1, wherein the one or more base has a rectangular shape.

4. A method of removing a dent from a vehicle, the method comprising the steps of:

providing a modular paintless dent removal tool for removing the dent from the vehicle, the paintless dent removal tool comprising:

a detachably removable stabilizer assembly having a top, bottom, rounded first leg, rounded second leg and a body extending therebetween, the body having an opening extending between the top of the stabilizer assembly and the bottom of the stabilizer assembly;

a detachably removable sleeve having a first end, a second end having a tab connector extending therefrom, and a threaded chamber extending between the first end and the second end, the sleeve positioned within the opening of the stabilizer assembly and connected thereto;

a glue tab detachably connected to the tab connector, the glue tab having a top member, a neck member, and a flexible bottom member, the glue tab configured to be detachably affixed to the dent on the vehicle;

a detachably removable threaded rod positioned within the threaded chamber of the sleeve, the threaded rod having a top end extending out from the top of the stabilizer assembly and a bottom end rotatably engaged with the threaded chamber of the sleeve;

one or more detachably removable rounded base detachably connected to the rounded first leg and detachably connected to the rounded second leg of the stabilizer assembly, the one or more base having one or more socket for receiving the rounded first leg and the rounded second leg of the stabilizer assembly, such that the rounded first leg and the rounded second leg selectively rotate within the socket so that the modular paintless dent removal tool may be positioned on a curved surface of the vehicle;

a detachably removable top member rotatably engaged with the top of the stabilizer assembly, the top member having an opening extending therethrough for receiving the threaded rod;

a detachably removable automatic drill detachably connected to the threaded rod, the automatic drill having a chuck for receiving the top end of the threaded rod, wherein, upon a rotational force being applied to the top end of the threaded chamber by the automatic drill, the sleeve is raised upwards towards the top of the stabilizer assembly such that when the glue tab is connected to the tab connector, the paintless dent removal tool automatically pulls the glue tab upward to substantially pull out the dent in the surface of the vehicle;

positioning the stabilizer assembly of the paintless dent removal tool on the surface of the vehicle such that the dent is positioned between the first leg of the stabilizer assembly and the second leg of the stabilizer assembly;

affixing the glue tab to the dent on the surface of the vehicle;

connecting the tab connector of the paintless dent removal tool to the glue tab;

connecting the automatic drill to the top end of the threaded rod; and automatically pulling the glue tab upward to substantially pull out the dent in the surface of the vehicle.

5. A modular paintless dent removal system for removing a dent from a vehicle, the modular paintless dent removal system comprising;

a first modular paintless dent removal tool comprising:

a detachably removable stabilizer assembly having a top, bottom, rounded first leg, rounded second leg and a body extending therebetween the body having an opening extending between the top of the stabilizer assembly and the bottom of the stabilizer assembly;

a detachably removable threaded rod positioned within the opening of the stabilizer assembly and connected thereto, the threaded rod having a top end and a bottom end, the bottom end having a tab connector detachably connected thereto;

a glue tab detachably connected to the tab connector, the Glue tab having a top member, a neck member, and a flexible bottom member, the glue tab configured to be detachably affixed to the dent on the vehicle;

one or more detachably removable rounded base detachably connected to the rounded first leg and detachably connected to the rounded second leg of the stabilizer assembly, the one or more base having one or more socket for receiving the rounded first legend the rounded second leg o the stabilizer as such that the rounded first leg and the rounded second leg selectively rotate within the socket so that the modular paintless dent removal tool may be positioned on a curved surface of the vehicle;

a detachably removable top member rotatably engaged with the top of the stabilizer assembly, the top member having a lever for raising the threaded rod upward;

wherein, upon use of the lever by a user, the threaded rod is configured to raise the threaded rod upward such that when the glue tab is connected to the tab connector, the paintless dent removal tool pulls the glue tab upward to substantially pull out the dent in the surface of the vehicle;

a second modular paintless dent removal tool comprising:

a detachably removable stabilizer assembly having a top, bottom, rounded first leg, rounded second leg and a body extending therebetween, the body having an opening extending between the top of the stabilizer assembly and the bottom of the stabilizer assembly;

a detachably removable threaded rod positioned within the opening of the stabilizer assembly and connected thereto, the threaded rod having a top end and a bottom end, the bottom end having a tab connector detachably connected thereto;

one or more detachably removable rounded base detachably connected to the rounded first leg and detachably connected to the rounded second leg of the stabilizer assembly;

a detachably removable top ember rotatably engaged with the top of the stabilizer assembly, the top member having a lever for raising the threaded rod upward;

wherein, upon the use of the lever by a user, the threaded rod is configured to raise the threaded rod upward such that when the glue tab is connected to the tab connector, the paintless dent removal tool pulls the glue tab upward to substantially pull out the dent in the surface of the vehicle.

* * * * *